US008341768B2

(12) United States Patent
Gellerstedt

(10) Patent No.: US 8,341,768 B2
(45) Date of Patent: Jan. 1, 2013

(54) SURGICAL GARMENT WITH MEANS FOR AFFIXING A GLOVE THERETO

(75) Inventor: Fredrik Gellerstedt, Onsala (SE)

(73) Assignee: Molnlycke Health Care AB, Gothenburg (SE)

( * ) Notice: Subject to any disclaimer, the term of this patent is extended or adjusted under 35 U.S.C. 154(b) by 145 days.

(21) Appl. No.: 12/745,001

(22) PCT Filed: Dec. 8, 2008

(86) PCT No.: PCT/SE2008/051417

§ 371 (c)(1),
(2), (4) Date: Dec. 10, 2010

(87) PCT Pub. No.: WO2009/078789

PCT Pub. Date: Jun. 25, 2009

(65) Prior Publication Data

US 2011/0083244 A1 Apr. 14, 2011

(30) Foreign Application Priority Data

Dec. 18, 2007 (SE) ..... 0702812

(51) Int. Cl.

| | |
|---|---|
| ***A41D 19/015*** | (2006.01) |
| ***A41B 7/06*** | (2006.01) |
| *A41B 7/00* | (2006.01) |
| *A41D 13/12* | (2006.01) |

(52) U.S. Cl. ..... 2/161.7; 2/161.6; 2/123; 2/128; 2/160

(58) Field of Classification Search ..... 2/457, 16, 2/17, 82, 123, 128, 160, 161.6, 161.7, 162, 2/170

See application file for complete search history.

(56) References Cited

U.S. PATENT DOCUMENTS

| | | | |
|---|---|---|---|
| 3,736,595 | A | 6/1973 | Siegmann |
| 4,290,148 | A | 9/1981 | Roberts |
| 4,884,300 | A | 12/1989 | Vistins |
| 5,749,098 | A | 5/1998 | Evans |
| 6,235,659 | B1 | 5/2001 | McAmish et al. |
| 6,530,090 | B1 | 3/2003 | Ambrose et al. |
| 2003/0079272 | A1 | 5/2003 | Poppe |
| 2006/0185059 | A1 | 8/2006 | Taha et al. |

FOREIGN PATENT DOCUMENTS

| | | |
|---|---|---|
| GB | 2 424 356 | 9/2006 |
| KR | 2009 0005578 | 6/2009 |
| WO | 2005/102086 | 11/2005 |

OTHER PUBLICATIONS

International Search Report with Written Opinion issued on Mar. 10, 2009 for Intl. App. No. PCT/SE2008/051417, filed on Dec. 8, 2008 (Inventor—Gellerstedt, F.; Applicant—Mölnlycke Health Care AB; pp. 1-9).

(Continued)

*Primary Examiner* — Bobby Muromoto, Jr.
(74) *Attorney, Agent, or Firm* — Ballard Spahr LLP

(57) ABSTRACT

A surgical garment (1) has a front portion (2) and a back portion (3) and two sleeves (4). Each sleeve (4) has at least one adhesive region (6) for affixing a donned surgical glove (11) thereto, each such region (6) being covered by a strip (7) of release material being removable from the associated adhesive region (6) in a sterile manner after donning of the surgical glove (11).

11 Claims, 1 Drawing Sheet

OTHER PUBLICATIONS

International Preliminary Report on Patentability issued on Jun. 22, 2010 for Intl. App. No. PCT/SE2008/051417, filed on Dec. 8, 2008 (Inventor—Gellerstedt, F.; Applicant—Mölnlycke Health Care AB; pp. 1-6).

International Search Report dated Mar. 10, 2009, from corresponding PCT application.

Supplementary European Report issued on Oct. 10, 2012 for EP application No. 08861301.3 (priority to PCT/SE2008/051417) (Inventor—Gellerstedt, F.; Applicant—Applicant—Mölnlycke Health Care AB; pp. 1-6)

SURGICAL GARMENT WITH MEANS FOR AFFIXING A GLOVE THERETO

TECHNICAL FIELD

The present invention relates to a surgical garment having a front portion and a back portion and two sleeves.

BACKGROUND OF THE INVENTION

Single use surgical gowns have for many years been manufactured with hydroentangled nonwovens, exemplified by Sontara (DuPont, USA). Hydroentangled nonwovens are made from a mix of pulp fibers and synthetic fibers. A cuff of stitched cotton is usually positioned in the low end of the sleeve for comfort and to keep the gown in place and facilitate sterile donning of the surgical gloves.

In recent years, other nonwoven materials have been introduced as alternatives to hydroentangled nonwovens, e.g. SMS nonwovens. SMS nonwoven is constituted of several layers of fibrous webs where an inner layer of meltblown fibers is placed between layers of spunbond fibers. The most common polymers used are polypropylene but polyethylene and copolymers of polyethylene and polypropylene can also be found.

The surgical staff is dressed in sterile surgical gowns in order to avoid transmittance of bacteria to the patient. After donning of the gown, the wearer puts on surgical gloves. The gloves are most often designed with a long cuff portion thus allowing a good enough overlap between the glove and sleeve. The overlap should be with a safety margin to avoid fluid transport in between the sleeve and glove thus creating a breach of the sterile barrier.

Cellulose based hydroentangled nonwovens have typically a relatively high friction towards the glove cuff portion thus maintaining the donned surgical glove securely fit up-tight on the arm of the wearer. The SMS nonwoven consisting of oil based materials has a significantly lower friction towards a surgical glove. Having SMS material as a surgical gown sleeve creates hence a problem to the wearer. During the surgical procedure, the interface between the glove and sleeve are subjected to shear forces that may have the effect that, in the SMS case, the glove cuff slides down the arm which is experienced as uncomfortable by the wearer and also constitutes an increased risk for a sterility breach which may consequently cause postsurgical complications to the patient.

Many attempts have been made to solve this increasingly important problem. According to US 2006/0185059 A1, a self-adherent wrap is used to secure a surgical glove to the surgical gown. Such a solution has the drawback that rather complicated maneuvers have to be made for applying said wrap after the donning of the glove and as consequence thereof such a secured glove is not easy to take off the user without damaging the surgical gown.

U.S. Pat. No. 6,530,090 B1 describes a surgical garment sleeve having raised profiles of a high friction substance attached as beads or rings. The raised profiles aim to lock the glove in place due to its locally increased thickness in combination with friction. Another solution proposed for obtaining a secure glove to sleeve interface is to coat portions of the sleeve that is included in the glove to sleeve interface with a substance having high friction as described in U.S. Pat. No. 6,235,659. Another solution is presented by the Microcool® SecureFit® surgical gown manufactured by Kimberly-Clark (USA) where the lower end of the sleeve has a low tack adhesive applied. The low tack adhesive increases the friction between the sleeve and the inner surface of the surgical glove.

However, the frictional forces created by such solutions are not always enough to ensure that the glove does not glide on the sleeve. Furthermore, frictional contact between the glove and the sleeve may disturb the donning of the glove.

WO2005102086A1 describes a surgical gown having gloves adhesively attached to a sleeve of the gown and hence integrated with the surgical gown. Upon donning of the gown, the glove will automatically slip on. The glove may be removed from the gown without compromising material integrity of neither the gown nor the removed glove. A disadvantage by such a solution is that it is complicated for the user to don a gown with gloves integrated into the sleeves. Furthermore, there may be problems for the user in finding a fitting combination of gown and glove.

As another solution to gloves sliding down the sleeves of the gown, patent US 2003/0079272 A1 describes a surgical gown having extended sleeves that allows part of the sleeve to act as flaps over the glove to sleeve interface thus protecting the interface from exposure to fluids. Also this solution leads to a complicated donning of gown and gloves.

The objective of the present invention is to create a surgical garment having a front portion and a back portion and two sleeves and having means for a reliable attachment of a donned glove to the sleeve of a gown without complication of the manner in which a glove is donned.

SUMMARY OF THE INVENTION

This objective is accomplished by a surgical garment having a front portion and a back portion and two sleeves, characterised in that each sleeve has at least one adhesive region for affixing a donned surgical glove thereto, each such region being covered by a strip of release material being removable from the associated adhesive region in a sterile manner after donning of the surgical glove. By having the adhesive region covered by a strip of release material, the adhesive does not interfere with the donning of a glove and an adhesive with high adhesion to the glove can then be used. After removal of the strip, the glove will be adhesively bonded to the sleeve, either the elastic force in the glove material will press the glove against the adhesive region or a light pressure is applied by the user.

In a preferred embodiment, each said adhesive region is located at a distance of 5-200 mm, preferably 50-150 mm from the interface between sleeve and cuff or a free end of the sleeve of a gown without cuffs. Each strip of release material is extended beyond the associated adhesive region in a direction towards the shoulder end of the sleeve provided with said associated adhesive region. Furthermore, each strip is divided into a first and second part by a fold, the first part covering the associated adhesive region, the second part covering the first part and extending beyond the first part in a direction towards the shoulder end of the sleeve provided with said associated adhesive region. The difference in length between the second and first part should be less than 200 mm.

The adhesive region is so disposed on its associated sleeve that a cuff portion of a donned glove covers the whole of said adhesive region whereas a portion of the second part of the strip of release material associated to said adhesive region preferably extend outside a donned glove.

Each strip of release material is preferably made of a polymer, such as polyester, polypropylene or polyethylene and the thickness of the strip of release material is preferably 36-200 micrometer.

Alternatively, each strip of release material is made of paper, preferably coated with silicone.

BRIEF DESCRIPTION OF THE DRAWINGS

The invention will now be described with reference to the enclosed figures, of which.

DESCRIPTION OF EMBODIMENTS

Figure 1:
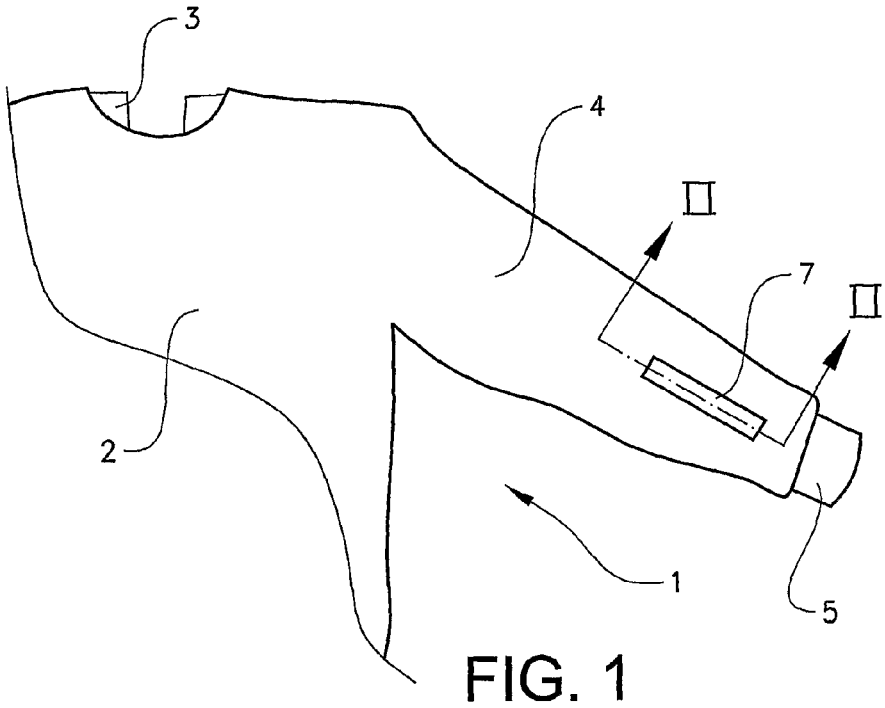
FIG. 1 schematically shows a front view of part of a surgical gown according to a preferred embodiment of the present invention.

A preferred embodiment of a surgical garment 1 in accordance with the present invention is schematically shown. Garment 1 is in the form of a surgical gown and includes a front portion 2, a back portion 3 and two sleeves of which only the right sleeve 4 is shown in the figures.

The surgical garment 1 can be made of any material that is used for such garments, for example a SMS nonwoven material, and each sleeve ends with a cuff 5 of stitched cotton.

Figure 2:
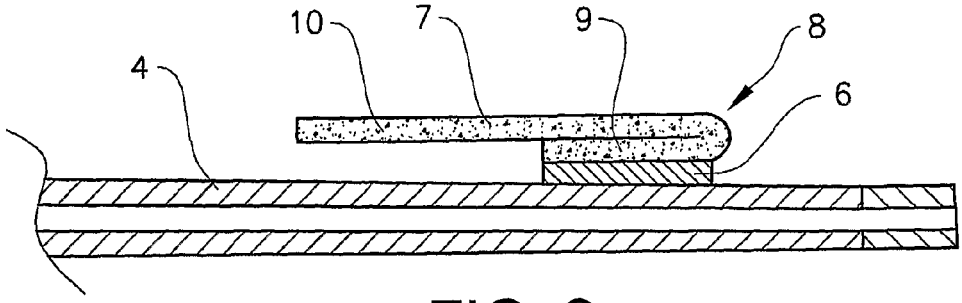
FIG. 2 shows a cross-sectional view along line II-II in FIG. 1.
Figure 3:
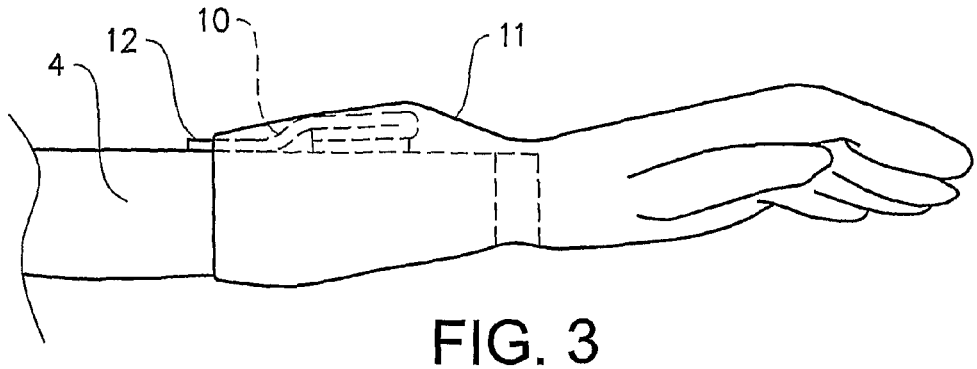
FIG. 3 shows a side view of the sleeve of the gown in FIG. 1 after donning of a glove.

According to the invention, an adhesive region is present on each sleeve, the region 6 on sleeve 4 being shown in FIGS. 2 and 3. The adhesive used is of an aggressive nature, i.e. an adhesive with a strong adhesion to the material in a surgical glove should be used.

Before use, the adhesive region 6 is covered by a strip 7 of release material, i.e. material that is easy to remove from the adhesive region 6 without impairing the function thereof by leaving small pieces of release material in the adhesive region or by taking pieces of the adhesive away from the adhesive region.

The strip 7 of release material is by a fold 8 divided into two parts, a first part 9 covering the adhesive region and a second part 10 extending over and beyond the adhesive region 6 in a direction towards the shoulder end of sleeve 4. The strip 7 has three functions, it on one hand protect the adhesive from dust and other contamination during storing and transport of the gown 1, and on the other hand protect the glove from contact with the aggressive adhesive during donning thereof. The third function is to allow easy removal of the strip after donning of a glove.

In order to be able to fulfill the third function, the second part 10 of the strip 7 must extend beyond the adhesive region 6 in a direction towards the shoulder end of the sleeve 4. Due to this feature, it is possible to locate the adhesive region 6 on the sleeve 4 so that the free end of second part 10 is extended beyond the end of a cuff of a donned glove. This is schematically illustrated in FIG. 3 in which the contour of a donned glove 11 is shown in part with interrupted lines. As can be seen in this figure, an end portion 12 of the second part 10 of strip 7 is extended beyond the end of the cuff of glove 11 in a direction towards the shoulder end of sleeve 4, i.e. to the left in FIG. 3. By having the end portion 12 of the second part 10 of the strip 7 of release material extending outside the cuff of glove 11, this end portion 12 is easy to grip for the wearer of the gown and by pulling the strip towards the shoulder end of sleeve 4, the strip is successively peeled of the adhesive region 6.

The cuff of glove 11 is elastic so it will by itself press against the adhesive region but it is also possible to apply a light pressure on the cuff of the glove to ensure that a firm attachment is achieved.

The release strip 7 can thus easily be removed from the sleeve 4 without risking sticking the glove fingers onto the aggressive adhesive.

The location of the adhesive region in relation to the cuff end of a glove is of course dependent on the length of the second part of the strip of release material and the length of the cuff of the glove used. It has been shown that if the adhesive region(s) is/are located at a distance of 5-200 mm, preferably 50-150 mm, from the interface between sleeve and cuff and the difference in length between the second and first part of the strip of release material is 120 mm, the strip will be extend outside the cuff of a donned glove. However, the difference in length between the second and first part of the strip of release material should be less than 200 mm. Thus, in order to fulfill the criteria of easy removal the adhesive region should be so disposed on its associated sleeve that a cuff portion of a donned glove covers the whole of said adhesive region whereas a portion of the second part of the strip of release material associated with said adhesive region extends outside the cuff of a donned glove.

Each strip of release material is preferably made of a polymer, such as polyester, polypropylene or polyethylene and the thickness of the strip of release material is preferably 36-200 micrometer. Such a thickness gives a relative stiffness that makes the strip unlikely to fold during donning of the glove onto the garment. On the donned garment, before and after putting on the glove, the release strip should essentially point towards the elbow of the wearer.

Alternatively, each strip of release material can instead be made of paper, preferably coated with silicone.

As a practical example of the invention, a double adhesive tape piece is placed onto each surgical gown sleeve at a distance of 70 mm from the sleeve to cuff interface. The adhesive is placed so that it faces towards the wearer when the garment is donned. The adhesive facing the gown material is of an aggressive character, for example an adhesive of acrylate type, which allows sustainability during the intervention. The adhesive region is covered with a release strip that is folded 180 degrees with a pull section pointing upwards along the sleeve of the gown. The release strip is made of polyester with a thickness of 60 micrometer. The length of the pull section of the strip extending in a direction towards the shoulder end of the sleeve from the fold in the strip is 120 mm. When pulling the release strip away from the adhesive region, the release strip will be successively removed thus exposing the underlying adhesive to the inner side of the glove cuff. A light pressure may optionally be necessary to assure that the adhesive sticks firmly to the glove.

In another example, two double adhesive tapes are placed onto each surgical gown sleeve at a distance of 70 mm from the sleeve to cuff interface. The two adhesive regions are separated from each other by approximately 100 mm. The adhesive layers are covered by release strips in accordance with previous example.

The size of each individual adhesive region may vary but should have a width of at least 7 mm and a length of at least 10 mm. A suitable width is 25 mm and a suitable length is 60 mm. The width of the adhesive should preferably not exceed 75 mm as the release strip then would be difficult to handle. In order to ensure that the adhesive region will not reach outside a donned glove, the length of the adhesive region shall not exceed 250 mm. The release strip must fully cover the adhesive but may, as an example, have a greater width as well as a greater length.

The intervals and dimensions stated in the foregoing take consideration of various sizes of gowns and gloves.

The embodiments described can of course be modified without leaving the scope of invention. For example, it is not absolutely necessary that the strip of release material is dimensioned so that a portion thereof is extended outside the cuff of a donned glove. It would be relatively easy to grip a strip ending just short of the end of the cuff of a donned glove by lifting the cuff of the glove or by gripping the end of the strip just before the end of the donning procedure. The number of adhesive regions on each sleeve can be more than the one or two regions mentioned in the examples but should not be more than four for the reason of easy of handling. The adhesive used can be an other PSA (Pressure Sensitive Adhesive) of another base than acrylate, for example a hot-melt. The invention shall therefore only be restricted by the wording of the enclosed patent claims.

The invention claimed is:

1. A surgical garment (1) having a front portion (2) and a back portion (3) and two sleeves (4), characterised in that each sleeve (4) has at least one adhesive region (6) for affixing a donned surgical glove (11) thereto, each such region (6) being covered by a strip (7) of release material being removable from the associated adhesive region (6) in a sterile manner after donning of the surgical glove (11) wherein each strip (7) is divided into a first and second part (9 and i0, respectively) by a fold (8), the first part (9) covering the associated adhesive region (6), the second part (i0) covering the first part (9) and extending beyond the first part (9) in a direction towards the shoulder end of the sleeve (4) provided with said associated adhesive region.

2. The surgical garment (1) according to claim 1, wherein each said adhesive region (6) is located at a distance of 5-200 mm, preferably 50-150 mm from the interface between sleeve (4) and cuff or a free end of the sleeve of a gown without cuffs.

3. The surgical garment (1) according to claim 2, wherein each strip (7) of release material is extended beyond the associated adhesive region (6) in a direction towards the shoulder end of the sleeve (4) provided with said associated adhesive region (6).

4. The surgical garment (1) according to claim 3, wherein the adhesive region (6) is so disposed on its associated sleeve (4) that a cuff portion of a donned glove (11) covers the whole of said adhesive region (6) whereas a portion (12) of the second part (10) of the strip (7) of release material associated to said adhesive region (6) extends outside a donned glove (11).

5. The surgical garment (1) according to claim 4, wherein the difference in length between the second (10) and first part (9) of said strip (7) of release material is less than 200 mm.

6. The surgical garment (1) according to claim 4, wherein each strip (7) of release material is made of paper, preferably coated with silicone.

7. The surgical garment (1) according to claim 4, wherein each strip (7) of release material is made of a polymer, such as polyester, polypropylene or polyethylene.

8. The surgical garment (1) according to claim 7, wherein the thickness of the strip (7) of release material is 36-200 micrometer.

9. The surgical garment (1) according to claim 1, wherein the width of each adhesive region is 7-75 mm and the length of each adhesive region is 10-250 mm.

10. The surgical garment (1) according to claim 5, wherein each strip (7) of release material is made of paper, preferably coated with silicone.

11. The surgical garment (1) according to claim 5, wherein each strip (7) of release material is made of a polymer, such as polyester, polypropylene or polyethylene.

* * * * *